US007843119B2

(12) United States Patent
Onishi

(10) Patent No.: US 7,843,119 B2
(45) Date of Patent: Nov. 30, 2010

(54) IMAGE DISPLAY APPARATUS AND IMAGE RECEIVING AND DISPLAYING APPARATUS

(75) Inventor: Tomoya Onishi, Kanagawa-Ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 624 days.

(21) Appl. No.: 11/678,789

(22) Filed: Feb. 26, 2007

(65) Prior Publication Data

US 2007/0200474 A1 Aug. 30, 2007

(30) Foreign Application Priority Data

Feb. 27, 2006 (JP) ..... 2006-049758

(51) Int. Cl.
*H01J 1/62* (2006.01)

(52) U.S. Cl. ..... 313/496; 313/495; 313/497

(58) Field of Classification Search ..... 313/309–311, 313/495–497
See application file for complete search history.

(56) References Cited

U.S. PATENT DOCUMENTS

| | | | | |
|---|---|---|---|---|
| 5,532,548 | A | 7/1996 | Spindt et al. | 313/422 |
| 5,690,530 | A | 11/1997 | Jin et al. | 445/24 |
| 6,104,136 | A | 8/2000 | Abe et al. | 313/495 |
| 6,420,824 | B1 | 7/2002 | Abe et al. | 313/495 |
| 6,489,718 | B1 * | 12/2002 | Schmid et al. | 313/495 |
| 7,002,565 | B2 * | 2/2006 | Allen et al. | 345/204 |
| 7,298,074 | B2 | 11/2007 | Yamazaki | 313/292 |
| 2001/0028215 | A1 * | 10/2001 | Kim | 313/495 |
| 2005/0146260 | A1 | 7/2005 | Yamazaki | 313/292 |
| 2006/0091783 | A1 * | 5/2006 | Jin et al. | 313/496 |

FOREIGN PATENT DOCUMENTS

| | | |
|---|---|---|
| CN | 1638003 | 7/2005 |
| JP | 10-241606 | 9/1998 |
| JP | 2005-116359 | 4/2005 |

OTHER PUBLICATIONS

"Dielectric Breakdown of Dielectrics", Cooperation Aggregate, Electricity Institute, pp. 259-261 (English Translation).
"Dielectric Breakdown of Dielectrics", Cooperation Aggregate, Electricity Institute, pp. 259-261.
Chinese Notification of the First Office Action dated Apr. 17, 2009, issued in Application No. 200710084277.9 (English translation).

* cited by examiner

*Primary Examiner*—Bumsuk Won
(74) *Attorney, Agent, or Firm*—Fitzpatrick, Cella, Harper & Scinto

(57) ABSTRACT

The spacer comprises an insulating member and a plurality of electroconductive members each including a portion enveloped with the insulating member within a region sandwiched between a region on which the anode is disposed and the first substrate, and the plurality of electroconductive members are arranged such that the portions of the electroconductive members enveloped with the insulating member are spaced apart from each other in a direction along which the first and second substrates are opposed.

6 Claims, 13 Drawing Sheets

IMAGE DISPLAY APPARATUS AND IMAGE RECEIVING AND DISPLAYING APPARATUS

BACKGROUND OF THE INVENTION

1. Field of the Invention

The present invention relates to a plane type image display apparatus equipped with electron-emitting devices and spacers.

2. Description of the Related Art

Recently, research and developments of plane type image display apparatuses, which are referred to so-called flat-panel displays, have been done briskly.

Generally, a plane type image display apparatus using electron-emitting devices is constituted of a display panel in which a first substrate (rear plate) and a second substrate (face plate) are disposed oppositely with keeping a predetermined distance, and which is a vacuum container. An electron source equipped with two or more electron-emitting devices is mounted on the first substrate, and an acceleration electrode (anode) for accelerating electrons released from the electron-emitting devices, and a light emitting member such as a phosphor which emits light by electronic collision are disposed on the second substrate. Usually, in such a display panel, in order to keep an inside in a vacuum atmosphere, gap-setting members called spacers are disposed between substrates.

Japanese Patent Application Laid-Open No. H10-241606 discloses spacers in which electroconductive members and insulating members are stacked by turns so as to suppress a discharge generated owing to an edge portion of each intermediate electrode layer provided on surfaces of the spacers, and each surface of which is further covered with a semiconductive film so as to prevent fluctuations of an electron beam trajectory by charge.

SUMMARY OF THE INVENTION

A spacer used for an image display apparatus is influenced by an electric field generated by potential difference applied between an anode and an electron-emitting device. That is, the electric field is applied to the spacer. Here, when electric field strength becomes $1.0\times10^7$ [V/m] or more, a withstand voltage (withstand voltage of a spacer interior) of a material of a spacer itself may become a matter.

According to the inventor's wholehearted analysis, it became clear that it was possible to increase the withstand voltage of the spacer interior in comparison with a case that a spacer was made of only an insulating member by adopting constitution of a spacer that insulating members and electroconductive members were stacked by turns. Although this reason is not clear, it seems that this constitution suppresses that electrons are multiplied, by flowing electrons little by little to the respective insulating members between the electroconductive members before electrons flow through an insulating member at a stretch to cause a dielectric breakdown.

By the way, when producing an image display apparatus, electroconductive residues may be generated, or during drive of an image display apparatus, a constitutionally weak portion of an electroconductive member which constitutes an anode may exfoliate and electroconductive dust may be generated.

FIG. 4 shows a part of a cross-section of an image display apparatus using spacers in which insulating members and electroconductive members are stacked by turns.

In the figure, reference numeral 1 denotes a rear plate, reference numeral 2 denotes a face plate, reference numeral 3 denotes a spacer, reference numeral 5 denotes row (X directional) wiring, reference numeral 6 denotes column (Y directional) wiring, reference numeral 10 denotes a phosphor film (phosphor), reference numeral 11 denotes a metal back (anode), reference numeral 101 denotes an insulating member, and reference numeral 102 denotes an electroconductive member.

Nevertheless, there is the following matter in the image display apparatus using the spacers 3 as shown in FIG. 4. That is, when the electroconductive member 102 is exposed or it is covered with an electroconductive member, electroconductive members 102 may short-circuit by electroconductive foreign materials 104 such as electroconductive residues and dust attaching to a surface of a spacer 3, and they may become an equal potential.

As a function for which the electroconductive member 102 of the spacer 3 is requested in the present invention, it is cited to become a desired potential (thus, a potential specification). It is because the potential of the electroconductive member 102 must become the desired potential so as to form such a potential distribution that an electron beam trajectory from an electron source becomes desired one. Here, when the electroconductive members 102 short-circuit with the electroconductive foreign material 104 as shown in FIG. 4, it will become impossible to fulfill the above-mentioned function.

In particular, it is known that an electroconductive foreign material reciprocates between the face plate 2 and rear plates 1 under an approximately parallel electric field, which is formed between the face plate 2 and rear plate 1, like the present invention (see, for example, Japanese Patent Application Laid-Open No. 2005-116359). Hence, there arises a possibility that an electroconductive foreign material mixed after formation of the image display apparatus adheres to the spacer 3 after the reciprocating motion. Thus, when producing an image display apparatus, which has the spacers 3, like the present invention, it is necessary to prevent the short circuit between electroconductive members by an electroconductive foreign material.

The present invention aims at preventing a discharge resulting from a short circuit of electroconductive members by an electroconductive foreign material in an image display apparatus which has spacers in which insulating members and electroconductive members are stacked An image display apparatus of the present invention, a first substrate provided with an electron-emitting device, a second substrate provided with an anode and a phosphor emitting light responsive to an irradiation with an electron emitted from the electron-emitting device, and a spacer disposed to support the first and second substrate between the first and second substrates, wherein the spacer comprises an insulating member and a plurality of electroconductive members each including a portion enveloped (covered) with the insulating member within a region sandwiched between a region on which the anode is disposed and the first substrate, and the plurality of electroconductive members are arranged such that the portions of the electroconductive members enveloped with the insulating member are spaced apart from each other in a direction along which the first and second substrates are opposed.

In the present invention, a spacer has an insulating member, and a plurality of electroconductive members at least a part of which are included in the above-described insulating material in a region which is sandwiched at least by the above-described anode and the above-described first substrate. Furthermore, the plurality of electroconductive members are disposed in a direction, along which the above-described first substrate and the above-described second substrate are opposed, with keeping a distance mutually in the above-described insulating member. Thereby, even when an electroconductive foreign material adheres on a surface of the spacer, the plurality of electroconductive members do not short-circuit, and a discharge is suppressed.

In addition, in the present invention, it is possible to set a potential of each electroconductive member by a high resistance film by adopting constitution that the above-mentioned spacer has a high resistance film which connects a plurality of electroconductive members, and the high resistance film is covered with the above-described insulating member. Thereby, it becomes possible to prevent a discharge in the spacer concerned by suppressing fluctuations of a potential owing to temporal charge of the surface of the spacer, and a temporal displacement of an electron beam is suppressed.

Further features of the present invention will become apparent from the following description of exemplary embodiments with reference to the attached drawings.

BRIEF DESCRIPTION OF THE DRAWINGS

FIG. 13 is a sectional view of the display panel of FIG. 1, taken along line X-Z of FIG. 1.

DESCRIPTION OF THE EMBODIMENTS

Hereafter, embodiments of the present invention will be explained.

An image display apparatus of the present invention is an apparatus which forms an image by irradiation of electrons released from electron-emitting devices to phosphors. In addition, the electron-emitting device includes a field emission type electron-emitting device, an MIM type device, a surface conduction electron-emitting device, etc. In particular, since the surface conduction electron-emitting device is simple in constitution and easy to produce, and has an advantage of being able to form many devices over a large area, it is preferably applied to the present invention.

An embodiment of the present invention will be specifically explained below using FIG. 1.

Figure 1:
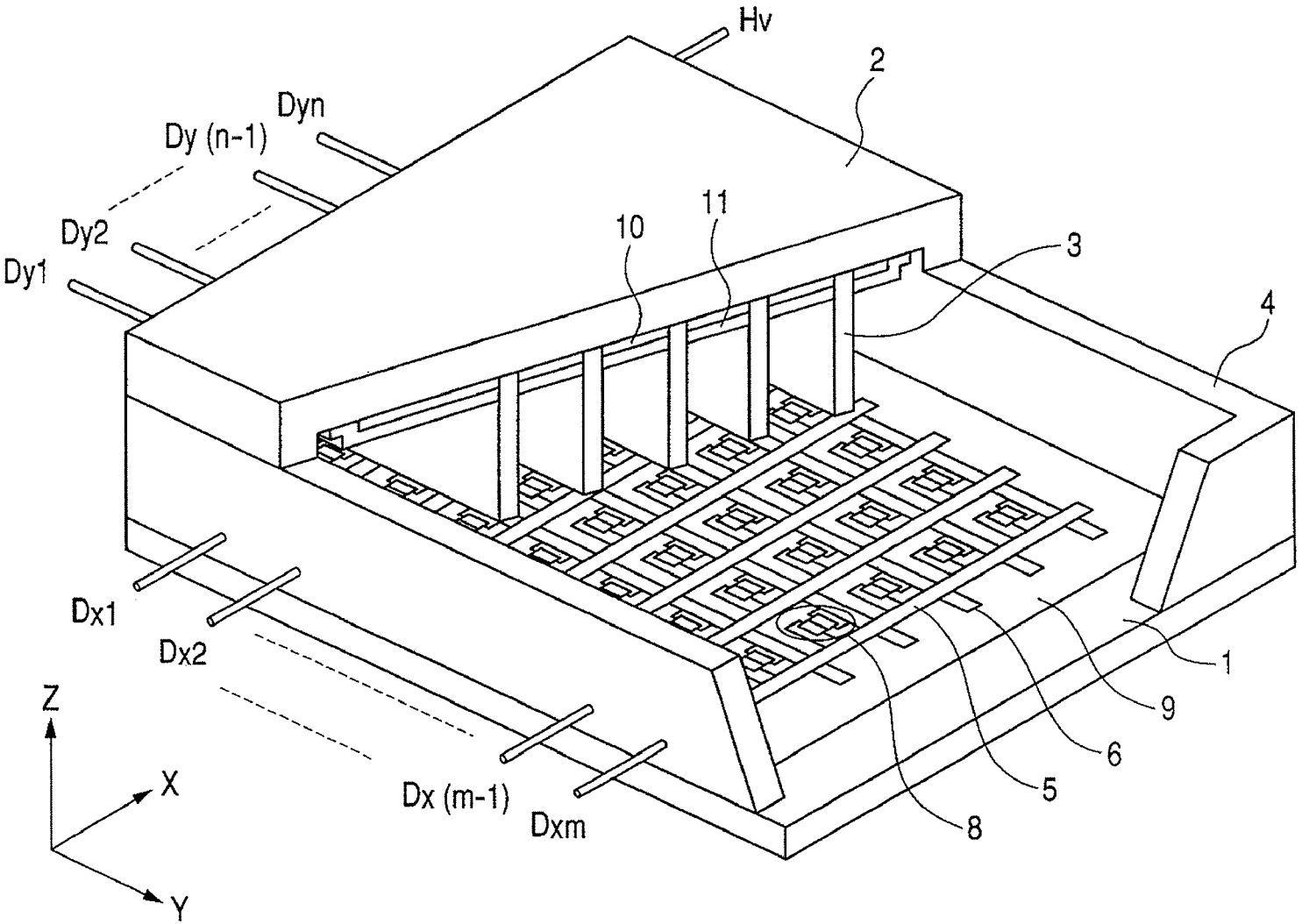
FIG. 1 is a partially cutaway perspective view of a display panel of an image display apparatus of the present invention.

FIG. 1 is a partially cutaway perspective view of a display panel of an image display apparatus (display panel) according to the present invention. In FIG. 1, reference numeral 1 is a rear plate (first substrate), reference numeral 2 denotes a face plate (second substrate), reference numeral 3 denotes a spacer (space defining member), and reference numeral 4 denotes a side wall. In addition, reference numeral 5 denotes row (X directional) wiring, reference numeral 6 denotes column (Y directional) wiring, reference numeral 8 denotes an electron-emitting device, reference numeral 9 denotes an electron source substrate, reference numeral 10 denotes a phosphor film (phosphor), and reference numeral 11 denotes a metal back (anode). The X direction is a direction that row wiring 5 is disposed, and the Y direction is a direction that column wiring 6 is disposed. A Z direction means a direction that the rear plate 1 and face plate 2 are opposed, and it is also possible to be called a normal direction of a surface of the rear plate 1 in a face plate 2 side. In addition, a direction that the first substrate and second substrate are opposed means a direction that a line which connects the first substrate and second substrate at a minimum distance faces.

As shown in FIG. 1, an image display apparatus according to the present invention has a constitution that the rear plate 1 and face plate 2 are made to be opposed at a spacing and a plurality of plate-like spacers 3 are sandwiched between both. Then, an environment of the rear plate 1 and face plate 2 is sealed by a side wall 4, and its interior is made to be a vacuum atmosphere.

A spacer 3 which is a feature of the present invention will be explained in detail.

Figure 2C:
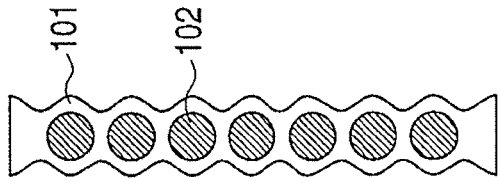
FIGS. 2A, 2B and 2C and FIG. 13 are sectional views of the display panels with several types of spacers taken on line X-Z in FIG. 1.
Figure 2B:
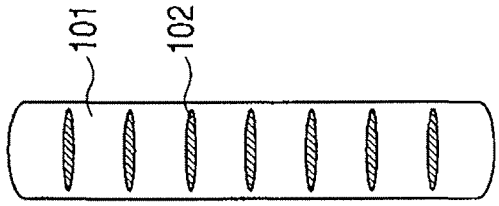
Figure 2A:
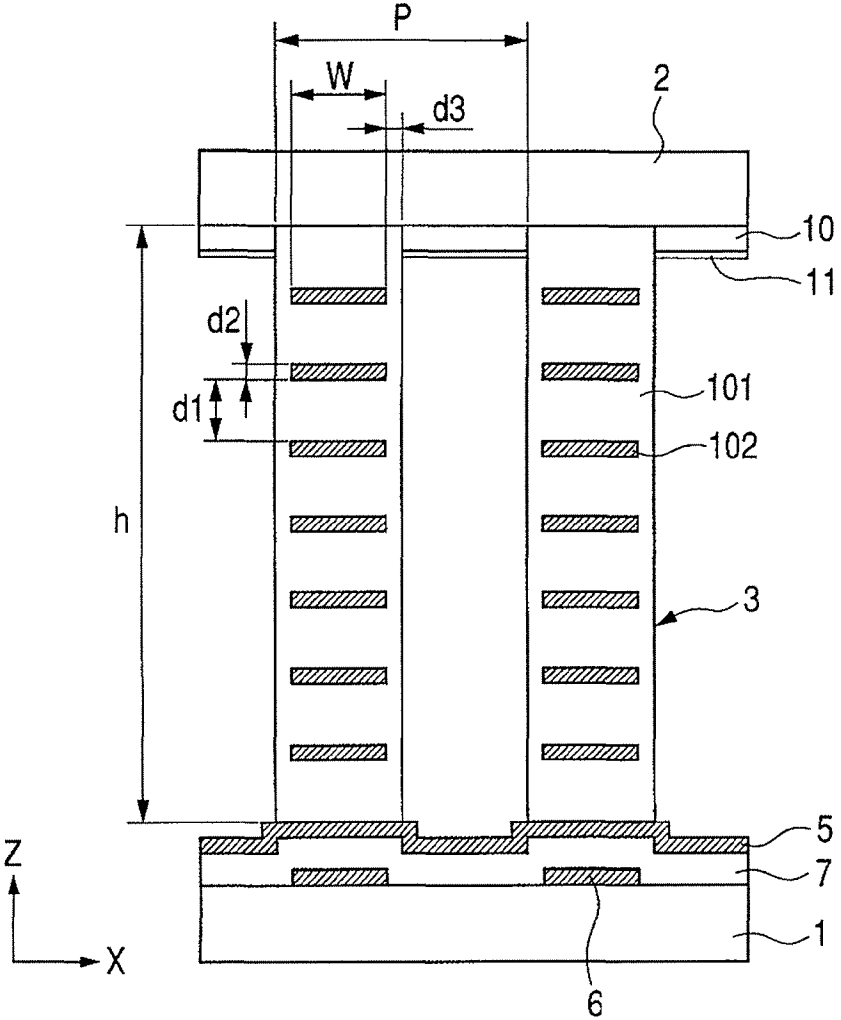

FIG. 2A is a partially enlarged sectional view of the image display apparatus taken on line X-Z in FIG. 1. In FIG. 2A, reference numeral 101 denotes an insulating material, and reference numeral 102 denotes an electroconductive member.

Figure 13:
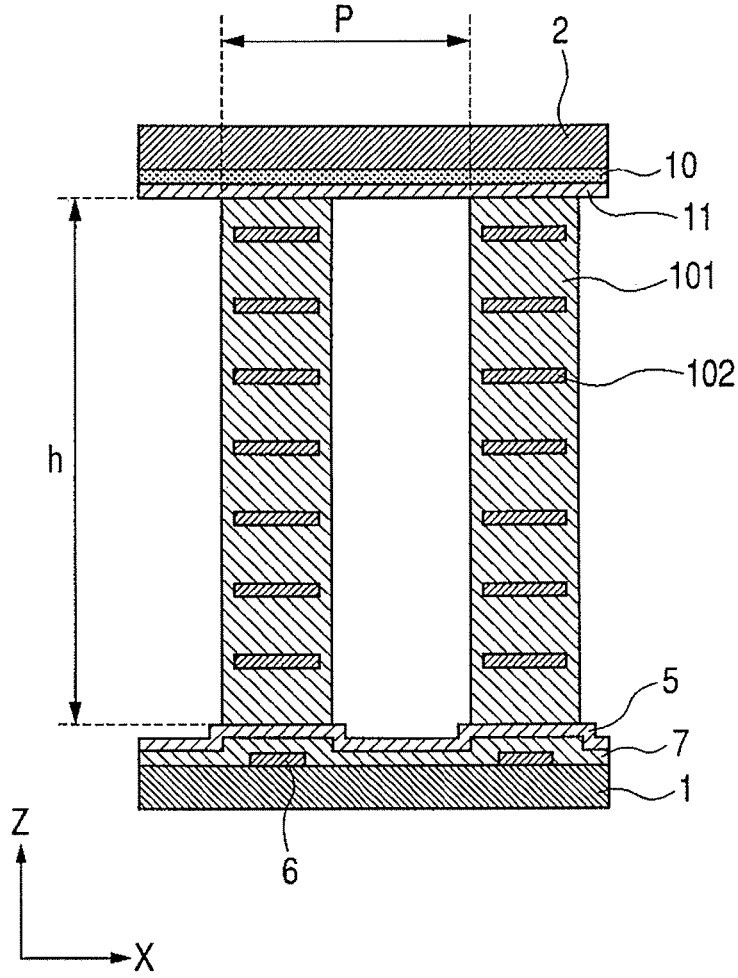

The spacer 3 may be what just maintains a gap between the rear plate 1 and face plate 2. Hence, the spacer 3 directly contacts the rear plate 1 and face plate 2 and can maintain this gap. In addition, it is also possible to adopt a constitution of sandwiching the row wiring 5 and column wiring 6 between the spacer 3 and rear plate 1, as shown in FIG. 2A, or constitution of sandwiching the metal back 11 and phosphor film 10 between the spacer 3 and face plate 2 as shown in FIG. 13.

A high voltage is applied between the rear plate 1 and face plate 2. This is for accelerating electrons and making phosphors emit light, and a voltage of about 5 to 15 kV is applied.

The image display apparatus of the present invention has constitution that the spacer 3 has the insulating member 101, and a plurality of electroconductive members 102 which are included by the insulating member 101 and are disposed in a direction that the face plate 2 and rear plate 1 are opposed at a spacing. Thereby, by reducing a thickness of the insulating member 101 sandwiched between the plurality of electroconductive members 102, it is possible to increase a withstand voltage effectually in comparison with a spacer which is made of only the insulating member 101. Here, the number of the plurality of electroconductive members 102 is preferably 3 to 20 practically, and is more preferably 5 to 10 in view of complicatedness of a process, a yield, and cost.

An X-Z sectional form of the spacer 3 is not limited to a rectangle as shown in FIG. 2A, and may be an ellipse as shown in FIG. 2B, or a surface may be wavy (concavo-convex form) as shown in FIG. 2C.

The electroconductive member according to the present invention means a series of regions of a member which has electroconductivity, and means the electroconductive member 102 in FIG. 2A. A form of the electroconductive member 102 is not limited to what is a rectangle in the X-Z section of the spacer as shown in FIG. 2A etc., and may be elliptical as shown in FIG. 2B, or may be circular as shown in FIG. 2C. In addition, the sectional form of the spacer 3, and the sectional form of the electroconductive member 102 are not limited to the combination of FIG. 2A, FIG. 2B, and FIG. 2C.

Figure 3:
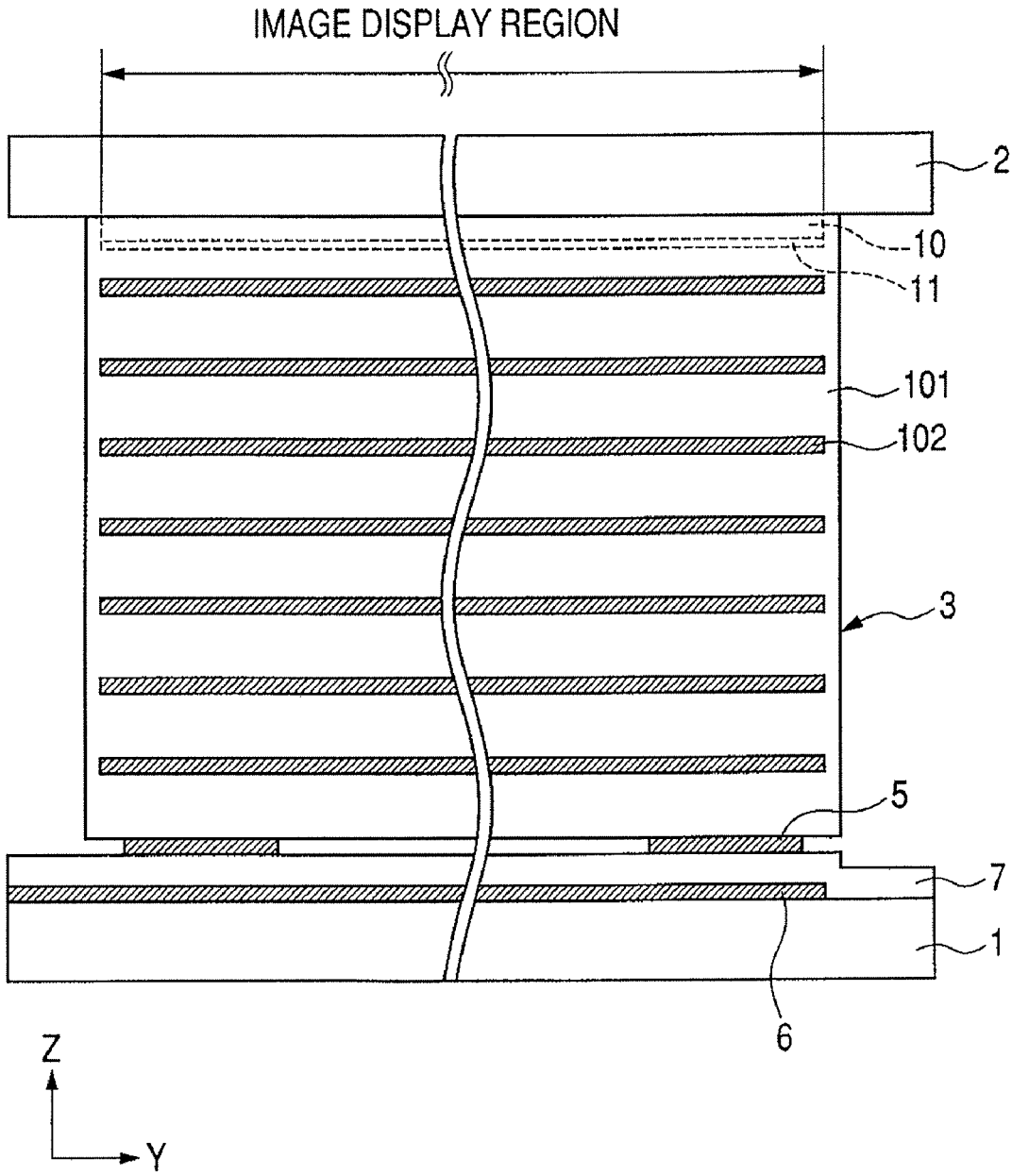
FIG. 3 is a sectional view of the display panel taken on line Y-Z in FIG. 1.
Figure 4:
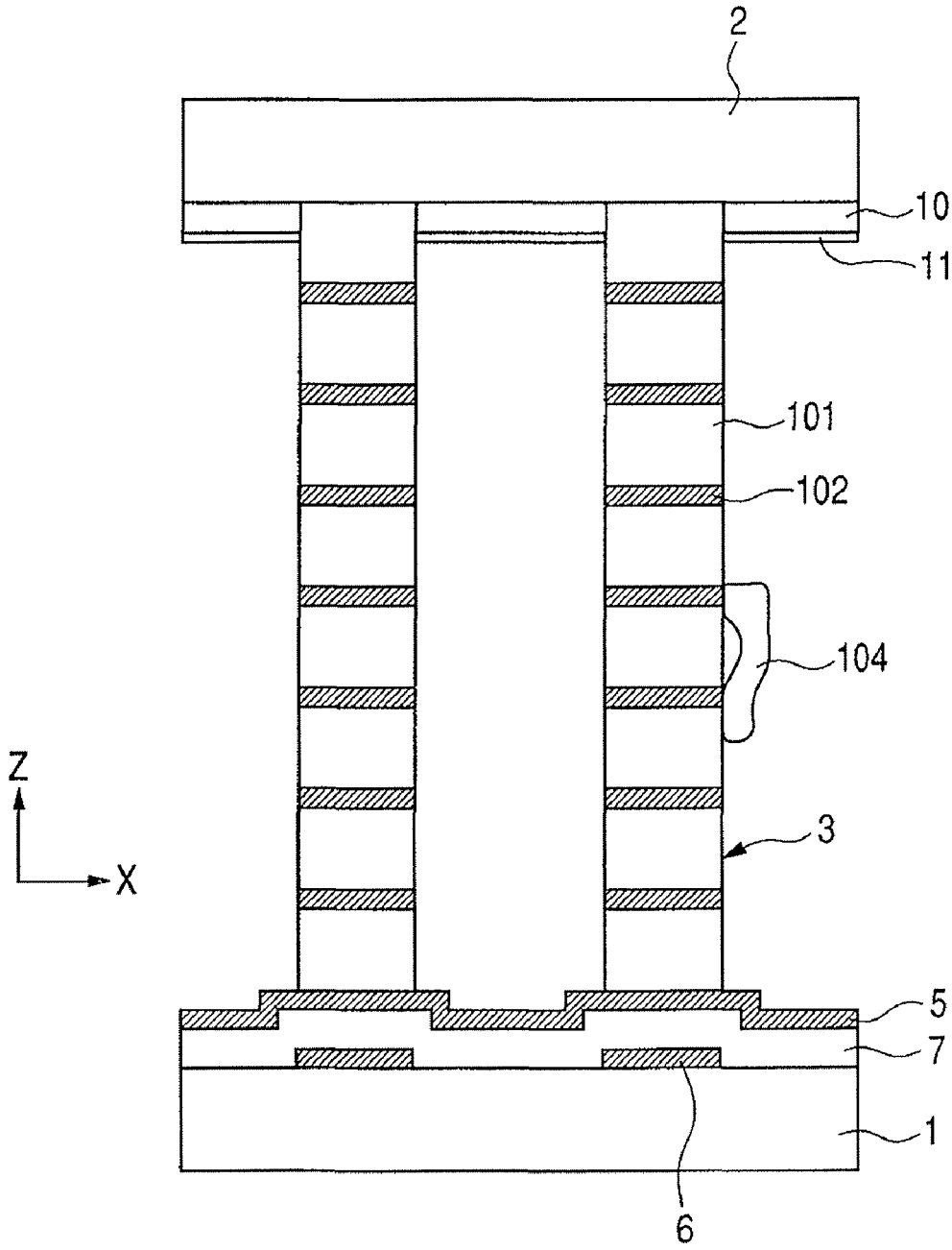
FIG. 4 is a drawing showing an aspect of a short circuit in a conventional spacer.

FIG. 3 is a drawing showing a Y-Z section of the image display apparatus shown in FIG. 1. In addition, the side wall 4 etc. is omitted for convenience. As shown in FIG. 3, let a region of being sandwiched between a region, where the metal back 11 is disposed, and the rear plate 1 be an image display region. Here, the region where the metal back 11 is disposed means a region surrounded by a line which connects outer periphery of the disposed metal back 11. In addition, when the metal back 11 is divided as shown in FIG. 3, a continuous region which includes wholly the metal back 11 divided and disposed is defined as the region where the metal back 11 is disposed.

As mentioned above, as for a member which constitutes the metal pack 11, a portion with low adhesive strength to a phosphor or a first substrate may exfoliate by a Coulomb force during driving an image display apparatus. For this reason, since a larger amount of electroconductive foreign material exists within the image display region in comparison with a region between the image display region and side wall 4, it is necessary that the plurality of electroconductive members 102 are covered with an insulating member particularly within the image display region lest they should expose on a surface of the spacer 3.

The following constitution is cited as a form of the spacer 3 used for the image display apparatus of the present invention.

(i) Structure that the electroconductive members 102 are included within the insulating member 101 as shown in FIG. 2A.

Figure 5:
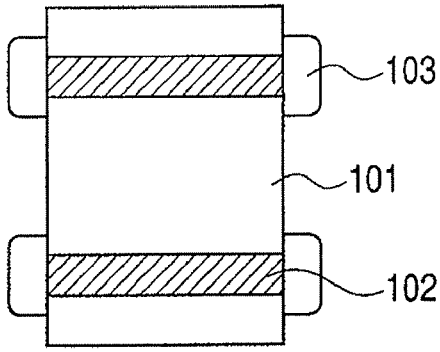
FIG. 5 is a drawing showing another embodiment of the spacer of the present invention.

(ii) Structure of forming the insulating layers 103 only on exposed sections of the electroconductive members 102 as shown in FIG. 5.

Figure 6:
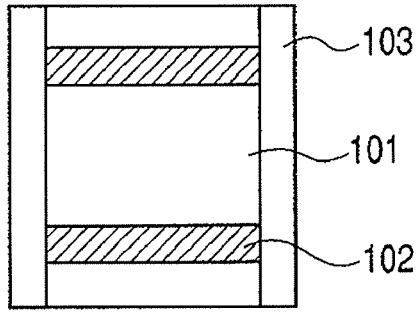
FIG. 6 is a drawing showing still another embodiment of the spacer of the present invention.

(iii) Structure of forming the insulating layer 103 on the whole sides of a constitution, in which the electroconductive members 102 and insulating members 101 are disposed by turns, as shown in FIG. 6.

Figure 7:
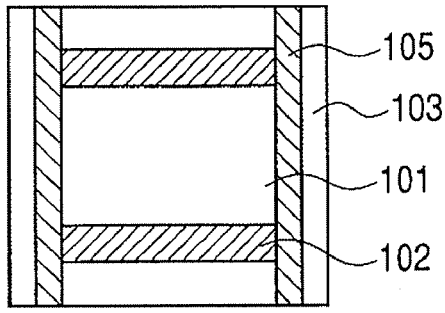
FIG. 7 is a drawing showing a further embodiment of the spacer of the present invention.

(iv) Structure of forming a highly resistive film 105 on the whole sides of a constitution, in which the electroconductive members 102 and insulating members 101 are disposed by turns, and forming the insulating layer 103 thereon, as shown in FIG. 7.

All have such constitution that the electroconductive members 102 do not short-circuit even if an electroconductive foreign material attaches to a surface of the spacer 3.

In FIG. 2A, let a distance between the electroconductive members 102 which adjoin each other with sandwiching the insulating member 101 be d1, let a thickness of the electroconductive member 102 be d2, let a distance from the electroconductive member 102 to a surface of the spacer 3 be d3, let a width of the spacer 3 in an X direction be W, and let a height of the spacer 3 in a Z direction be h. At this time, preferable dimensions of respective members are as follows.

The distance d1 is 20 μm or more and 200 μm or less, d2 is 1 μm or more and 100 μm or less, d3 is 5 μm or more and 30 μm or less, W is 30 μm or more and 200 μm or less, and h is 100 μm or more and 1000 μm or less. Furthermore, in view of complicatedness of a process, a yield, and cost, more preferable dimensions of respective members are as follows. The distance d1 is 30 μm or more and 80 μm or less, d2 is 5 μm or more and 20 μm or less, d3 is 10 μm or more and 30 μm or less, W is 50 μm or more and 100 μm or less, and h is 300 μm or more and 800 μm or less. In addition, as volume resistivity of the insulating member 101 and insulating layer 103, it is preferable to make it $1.0\times10^{8}$ [Ω·m] practically lest a potential of the electroconductive member 102 should fluctuate through the insulating member 101 or an electroconductive foreign material. Here, the volume resistivity is to be calculated by a so-called two-terminal method which performs measurement by contacting two terminals with a sample.

In addition, it is preferable in view of suppression of a discharge that a width of the electroconductive member 102 of the spacer 3 is 50% or more to a width of the spacer 3 in a direction (X direction) in which the spacers 3 are opposed. In other words, it is preferable that d3 is less than 50% of the width (W−2×d3) of the electroconductive member 102 in the X direction.

Furthermore, each electroconductive member 102 needs to be given potential specification. Here, the potential specification means to become a desired potential, and this also includes a potential distribution which is decided by either capacitance division or resistance division. Furthermore, it is effective to positively give a potential to the each electroconductive member 102. It is because reflection electrons from the face plate 2 are radiated on a spacer surface and the surface is charged. It is because it is possible at that time to suppress an electric potential change of the each electroconductive member 102 and to suppress charge of the insulating member 101. Furthermore, by controlling the potential suitably, it is possible to rationalize beam convergence by a so-called electron lens effect, and to achieve a small beam spot. As a specification method of the potential, as shown in FIG. 7, a method of providing the high resistance film 105 on a surface of a layered constitution which is constituted of the electroconductive members 102 and insulating members 101 can be cited. In this case, in order to perform short circuit prevention, the insulating layer 103 is further provided outside. In addition, as another specification method of the potential, it is also possible to apply a method of supplying the potential to a resistance film which is provided on surfaces (side faces) where the spacers 3 are opposed, that is, parts except the image display region or edges of the spacers 3 in a longitudinal direction (Y direction in FIG. 2A).

Next, a production method of spacers used for the present invention will be explained.

After forming the spacers 3 separately, it is possible to fix them to the face plate 2 or rear plate 1. At this time, the spacers 3 are fixable out of the image display region with fixing members not shown.

As the production methods of the spacers 3, methods such as a method of coating electroconductive paste and insulating paste by turns to make them in a laminating condition, and removing regions, which become ones between spacers, with sand blasting, and a printing method are applicable. In addition, it is also possible to apply a method of implanting ions into a plate-like insulating member to form electroconductive members.

In addition, the spacers 3 may be formed directly on the face plate 2 or rear plate 1. Thereby, it is possible to perform alignment of members on the face plate 2 or rear plate 1 with the spacers 3 at the time of formation of the spacers 3. That is, it becomes unnecessary to align all the three kinds of members (face plate/rear plate/spacers) (what is necessary is just to perform the alignment of two kinds of members). As such a method, for example, a method of coating electroconductive paste and insulating paste by turns on a surface of the face plate 2 or rear plate 1, and removing regions, which become ones between spacers, by sand blasting is preferably applicable.

Materials used for the insulating member 101 are not limited in particular so long as they can maintain a gap between the rear plate 1 and face plate 2 and fulfill withstand voltage performance, and for example, it is possible to cite polyimide, ceramic, glass, etc. In addition, in view of processes and cost, it is possible to use lead oxide or a bismuth oxide-based material preferably. Since there is comparatively little influence on an environment especially, it is possible to use the bismuth oxide-based material preferably.

Although metals such as silver, gold, copper, and aluminum are preferable as a material used for the electroconductive member 102, it is not limited so long as it is a material which has sufficiently large conductivity in comparison with the insulating member. It is possible to use, for example, a group IV element semiconductor such as silicon or germanium, a compound semiconductor such as gallium arsenide, an oxide semiconductor such as tin oxide, or the like as the electroconductive member 102, so long as it has 10 or more times of conductivity ratio to the insulating member. Since silver has especially good affinity with a print process, and can be formed with sufficient accuracy at low cost, it is more preferable.

What is necessary is just a common material which fulfills the physical properties (resistance, temperature characteristics, etc.) which can endure a high electric field as a material used for the high resistance film 105 of the constitution shown in FIG. 7. It is possible to cite, for example, a group IV element semiconductor such as silicon or germanium, a compound semiconductor such as gallium arsenide, an oxide semiconductor such as tin oxide. Or it is possible to cite what is formed into a film in an amorphous state, a polycrystalline state, or a single crystal state from an impurity semiconductor which is produced by adding a trace amount of impurity to each of the above-mentioned various semiconductors and a carbon material etc.

Next, the rear plate 1 used in the present invention will be explained.

On the rear plate 1, an electron source substrate 9 in which the row wiring 5, column wiring 6, insulating member between electrodes (not shown), and electron-emitting devices 8 are formed is fixed. The electron source substrate 9 may be used also as the rear plate 1.

The electron-emitting devices 8 shown are surface conduction electron-emitting devices in each of which electroconductive films which have an electron-emitting region between a pair of electrodes are connected to the electrodes. This example has a multi-electron beam source where N×M pieces of these surface conduction electron-emitting devices are disposed, and M lines of row wiring 5 which are formed at equal intervals respectively and N lines of column wiring 6 constitute matrix wiring. In addition, although the row wiring 5 is located on the column wiring 6 through the insulating member between electrodes in this example, it is also sufficient to dispose the column wiring 6 so as to mount on the row wiring 5. It is possible to apply a scanning signal to the row wiring 5 through extraction terminals Dx1 to Dxm, and to apply a modulating signal (image signal) to the column wiring 6 through extraction terminals Dy1 to Dyn. In addition, it is also sufficient to apply an image signal to the row wiring 5 and column wiring 6 directly without providing extraction terminals.

Since what is necessary is just a material which has sufficient electroconductivity as a constituent material of the row wiring 5 and column wiring 6, it is possible to apply metals such as gold, silver, and copper preferably. As a method of forming these wirings, for example, screen printing using a coating material mixed with a metal and glass paste, a plating method of depositing a metal using a plating bath material, etc. are preferably applicable.

Next, the face plate 2 used in the image display apparatus of the present invention will be explained.

The phosphor film 10 is formed on a surface of the face plate 2 in the rear plate 1 side. In the image display apparatus which can display an image in colors, it is possible to use phosphors with different luminescent colors for the phosphor film 10, and typically, it is possible to constitute it of a trichromatic phosphor of red (R), green (G), and blue (B).

In the present invention, charge may occur on a surface of the spacer 3 because electrons released from the electron-emitting device 8 and secondary electrons entered into and released again from the face plate 2 are radiated on the surface of the spacer 3. When the charge of the surface of the spacer 3 advances, a potential of the surface of the spacer 3 fluctuates. At this time by arranging the spacers 3 so as to sandwich one (one row of) electron-emitting device 8, the potential of the surfaces of the spacers 3 fluctuates almost symmetrically with centering the electron-emitting device 8. Hence, since equipotential surfaces between the face plate 2 and rear plate 1 become almost symmetrical with centering the electron-emitting device 8, it is possible to suppress a displacement of an electron beam. In addition, it is possible to prevent halation by providing the spacer 3 between phosphors of respective colors. The halation means that a part of electrons which are radiated from an electron source and reach the face plate 2 are released again from the face plate 2 as reflection electrons, and irradiate surrounding phosphors.

The metal back (acceleration electrode) 11 which is an electroconductive member provided on the face plate 2 is provided on a surface of the above-mentioned phosphor film 10. This metal back 11 accelerates and pulls up electrons released from the electron-emitting devices 8, and is given a high voltage from a high-voltage terminal Hv to be set at a high potential in comparison with the above-described row wiring 5. In the case of an image display apparatus using a surface conduction electron-emitting device as an electron-emitting device, usually, potential difference is formed between the electron-emitting device 8 (the row wiring 5 or column wiring 6) and metal back 11. Although it is preferable that this potential difference is large, in order to display a high-intensity image, electric field strength becomes strong between the electron-emitting device 8 and metal back 11 as it becomes large, and hence, it becomes easy to cause a discharge. On the other hand, in order to relax electric field strength, it is also possible to widen a gap between the electron-emitting device 8 and metal pack 11. Nevertheless, since it is necessary to make high an height of the spacers which maintains substantially the gap between the electron-emitting device 8 and metal pack 11, cost increases. Hence, it is practically preferable that the potential difference applied between the electron-emitting device 8 and metal back 11 is 10 kV to 15 kV in view of brightness and cost. Then, it is practically preferable that the height h of he spacers 3 in a Z direction is 100 μm to 1000 μm in view of a withstand voltage and cost. In addition, the present invention is especially effective in that it can suppress a discharge, when corresponding to the electric field strength of $1.0\times10^7$ or more V/m.

Although the phosphor film 10 and metal back 11 may have been formed on the face plate 2 beforehand, a method of forming these after forming the spacers 3 on the face plate 2 is preferable. This is because, when the spacers 3 are formed by sand blasting, it is possible to prevent degradation by a thermal process of phosphors.

Although the phosphor film 10 can be provided by various methods, typically, it can be provided by a printing method.

As a material used for the metal back 11, what is necessary is just to be an electroconductive member, and hence, Al can be used typically. Although the metal back 11 can be provided by various methods, typically, it is formed by vacuum deposition.

In addition, an image receiving and displaying apparatus can be constituted using the image display apparatus of the present invention explained using FIG. 2A etc.

Figure 12:
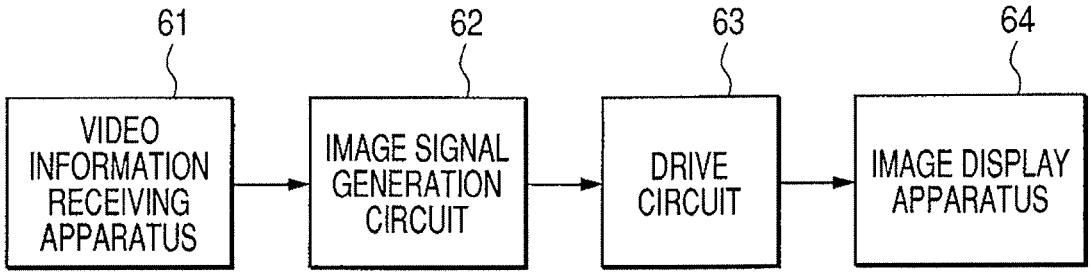
FIG. 12 is a block diagram showing constitution of an image receiving and displaying apparatus of the present invention.

FIG. 12 is a diagram showing schematic constitution of an image receiving and displaying apparatus using the image display apparatus of the present invention. In FIG. 12, reference numeral 61 denotes an image information receiving apparatus, reference numeral 62 denotes an image signal generation circuit, reference numeral 63 denotes a drive circuit, and reference numeral 64 denotes the image display apparatus of the present invention. First, a video signal received by tuning in the image information receiving apparatus 61 is inputted into the image signal generation circuit 62, and an image signal is generated. As the image information receiving apparatus 61, for example, a receiver such as a tuner which can tune and receive radio broadcasting, cable broadcasting, image broadcasting through the Internet, etc. can be cited. In addition, it is possible to constitute a TV set by connecting an acoustic apparatus etc. to the image information receiving apparatus 61, and further including the image signal generation circuit 62, drive circuit 63, and image display apparatus 64. The image signal generation circuit 62 generates an image signal corresponding to each pixel of the image display apparatus 64 from image information, and inputs the image signal into the drive circuit 63. Then, the drive circuit 63 controls a voltage applied to the image display apparatus 64 on the basis of the inputted image signal to make the image display apparatus 64 display an image.

EXAMPLES

The present invention will be explained below in detail with citing specific examples.

Example 1

In this example, an image display apparatus using the spacers 3 shown in FIG. 2A was produced.

Hereafter, the production method of the image display apparatus of this example will be explained.

[Production of Face Plate and Spacers]

The production method of the face plate 2 and spacers 3 will be explained using FIGS. 8A to 8D.

(Process a)

Soda lime glass was prepared as the face plate 2, and its surface was cleaned.

(Process b)

Bismuth oxide-based insulating paste 81 ("NP7753" made by NORITAKE) was coated on a surface of the cleaned soda lime glass by a slit coater so that a film thickness after baking might become 40 μm, and was dried at 120° C. for 10 minutes.

(Process c)

Figure 8A:
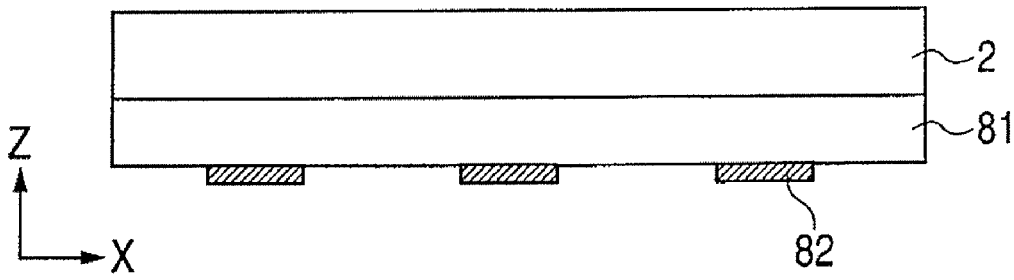
FIG. 8A is a drawing showing a production process of the spacer according to the present invention.

Silver electroconductive paste 82 ("NP4732" made by NORITAKE) was formed on the dried insulating paste 81 with screen printing so that a film thickness after baking might become 10 μm, and was dried at 120° C. for 10 minutes. As to a formed pattern, only a portion where the electroconductive member 102 would be formed at the time of sand blasting mentioned later (FIG. 8A). Next, bismuth oxide-based insulating paste 81 ("NP7753" made by NORITAKE) was coated by a slit coater so that a film thickness after baking might become 40 μm, and was dried at 120° C. for 10 minutes.

(Process d)

Figure 8B:
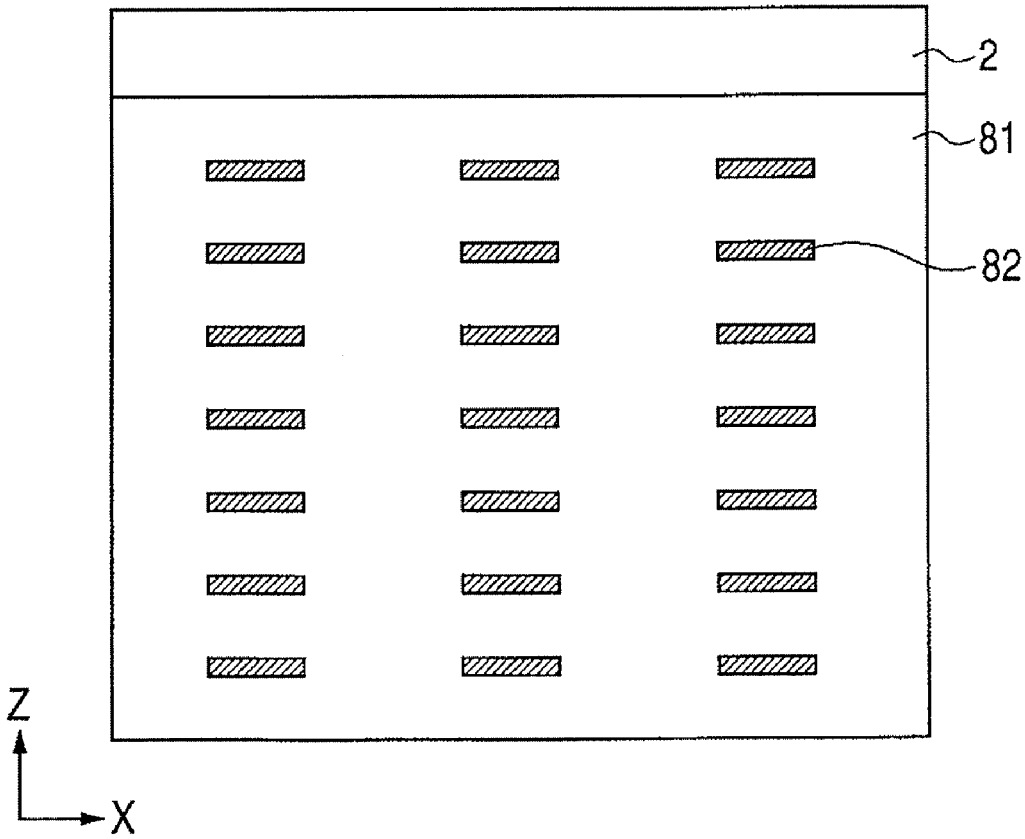
FIG. 8B is a drawing showing a production process of the spacer according to the present invention.
Figure 8C:
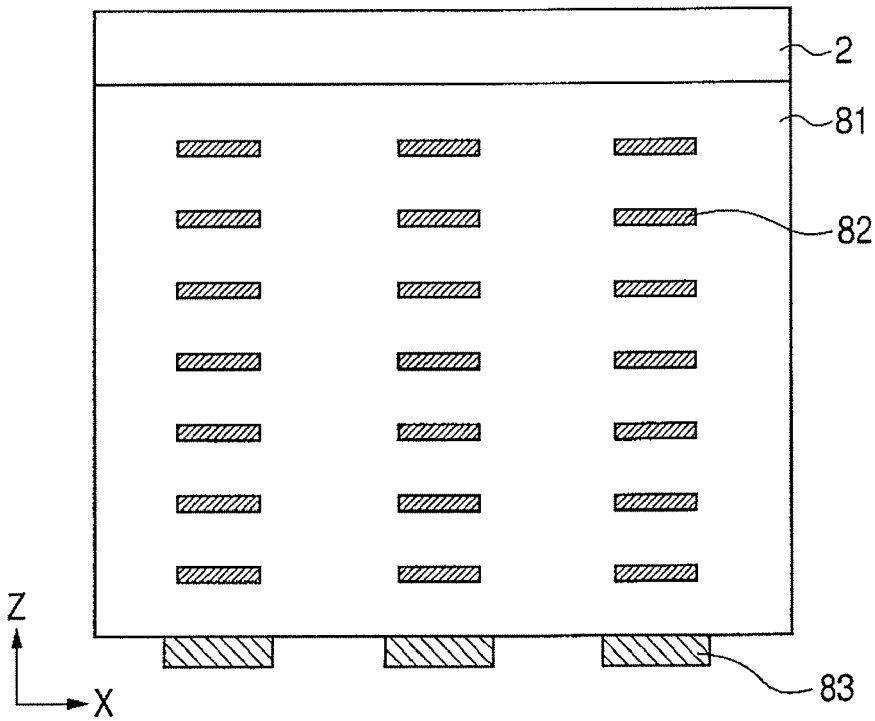
FIG. 8C is a drawing showing a production process of the spacer according to the present invention.

Process c was repeated 6 times after that (FIG. 8B)

(Process e)

A mask 83 for sand blasting was formed using dry film resist (DFR) (FIG. 8C), and unnecessary insulating paste 81 was removed by sand blasting. Subsequently, the dry film resist exfoliated with a release liquid, cleaning was performed, and baking was performed at 570° C. for 10 minutes.

(Process f)

The phosphor film 10 was formed between the spacers 3 by screen printing using paste in which P22 phosphors used in a CRT field were dispersed. In addition, in this example, three color of R, G, and B were stripe coated so as to produce a color display. A film thickness of the phosphor film 10 was made 15 μm.

(Process g)

Figure 8D:
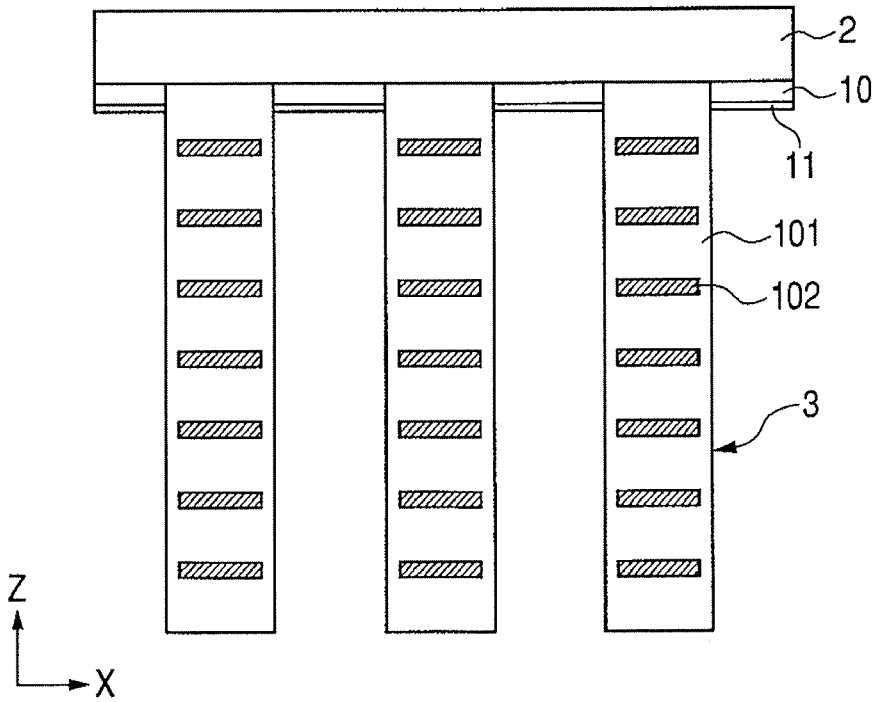
FIG. 8D is a drawing showing a production process of the spacer according to the present invention.

After coating acrylic emulsion by a spray coat method on the phosphor film 10 and drying it, an aluminum film was formed by mask vacuum deposition to be made the metal pack 11. An aluminum film thickness was made to be 100 nm (FIG. 8D).

As for the spacers 3 produced through the above processes, d1 was 40 μm, d2 was 10 μm, d3 was 10 μm, W was 80 μm, h was 390 μm, and P was 160 μm.

In addition, the material used for the insulating member 101 was coated on a test pattern, and was dried and baked. When its resistance was measured, volume resistivity was $1.0\times10^{10}$ Ω·m.

[Production of Rear Plate]

After an electron source was formed by forming 100×300 pieces of surface conduction electron-emitting devices on the rear plate 1 which served also as a substrate, and performing matrix-like wiring, the image display apparatus was produced using this. Hereafter, production procedure will be explained with referring to FIGS. 9A to 9D. A pitch of the row wiring 5 was made to be 480 μm, and a pitch of the column wiring 6 was made to be 160 μm.

Figure 9A:
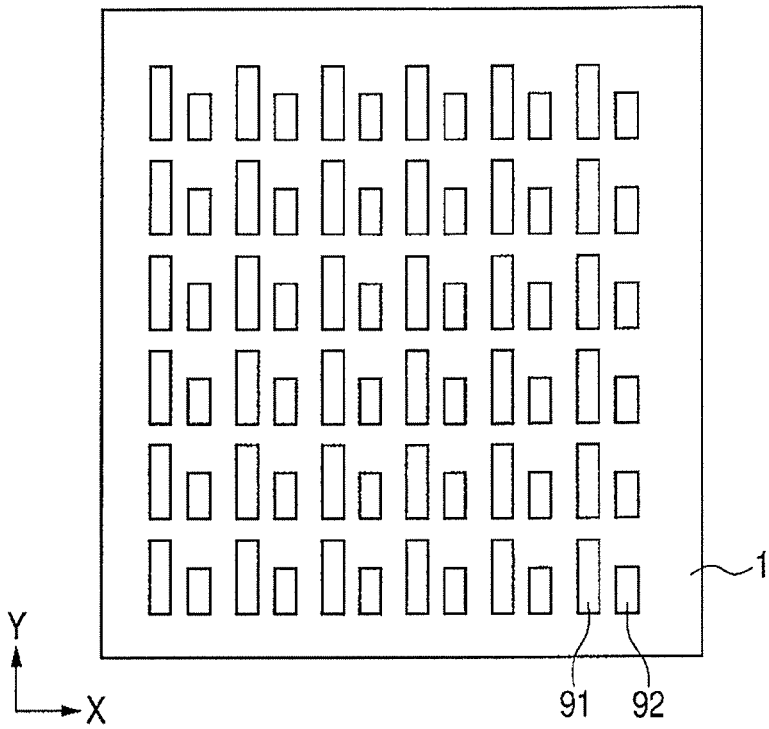
FIG. 9A is a drawing showing a production process of an electron source on a rear plate according to the present invention.

A 0.5-μm-thick $SiO_2$ layer was formed on a surface of cleaned soda lime glass by sputtering to be made the rear plate 1. On the rear plate 1, first electrodes 91 and second electrodes 92 of the surface conduction electron-emitting devices were formed using a sputter film formation method and a photolithographic method were used. As to their materials, 5-nm-thick Ti and 100-nm-thick Ni were stacked. Each gap between the first electrodes 91 and second electrodes 92 was 2 μm (FIG. 9A).

Figure 9B:
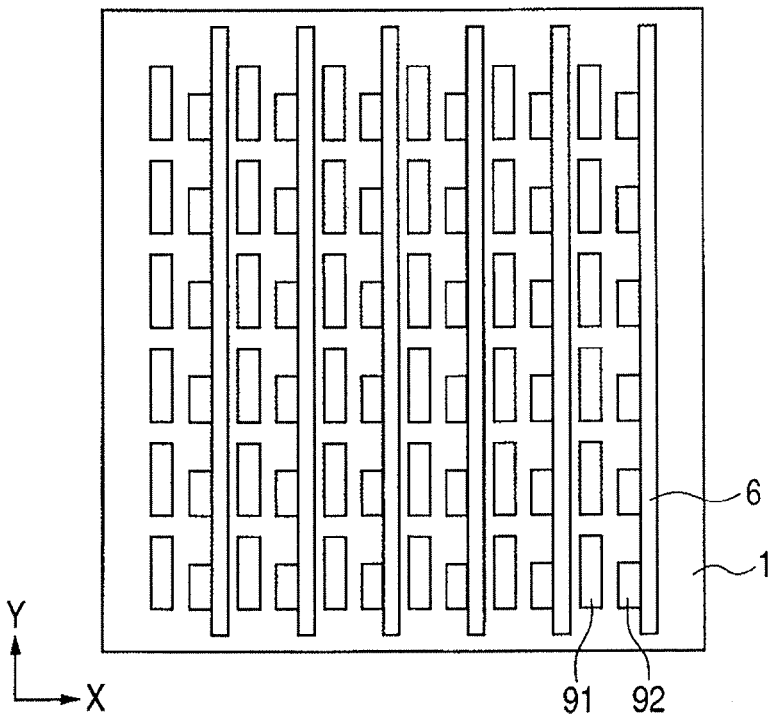
FIG. 9B is a drawing showing a production process of the electron source on the rear plate according to the present invention.

The column wiring 6 was formed by printing and baking Ag paste in a predetermined form. The wiring was extended to the exterior of the image display region, and was connected to the extraction terminals Dy1 to Dyn. A width of the column wiring 6 was 80 μm, and a thickness was about 10 μm (FIG. 9B).

An insulating member 93 was formed similarly by the printing method using paste in which a main component was PbO and glass binder was mixed. This insulated the column wiring 6 and the below-mentioned row wiring 5, intersected the column wiring 6, and was formed so that it might become about 20 μm in thickness. In addition, by providing a notch in each portion of the first electrodes 91, connection between the row wiring 5 and first electrodes 91 was performed.

Figure 9C:
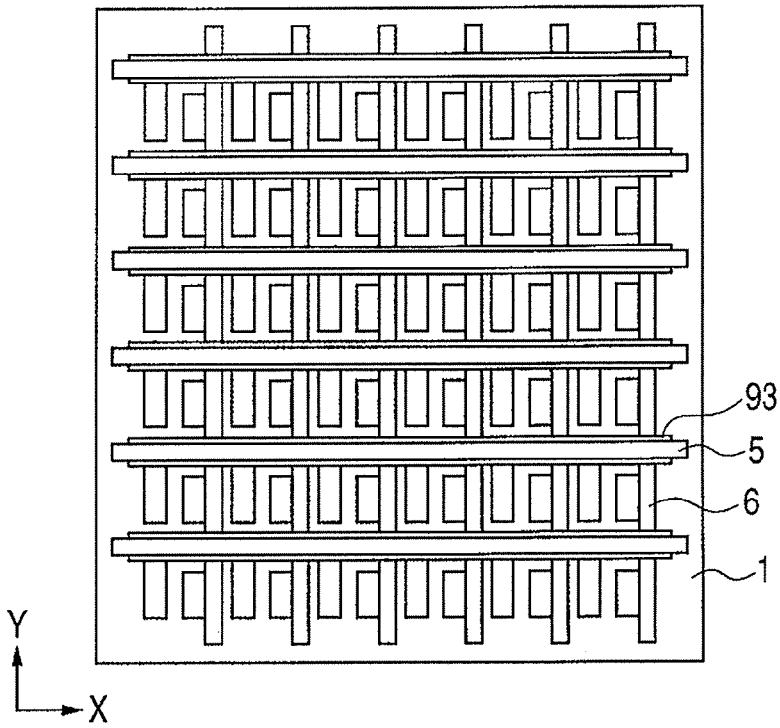
FIG. 9C is a drawing showing a production process of the electron source on the rear plate according to the present invention.

The row wiring 5 was formed on the above-mentioned insulating member 93 (FIG. 9C). A method was the same as the case of the column wiring 6, a width of the row wiring 5 was 240 μm, and a thickness was about 10 μm.

Figure 9D:
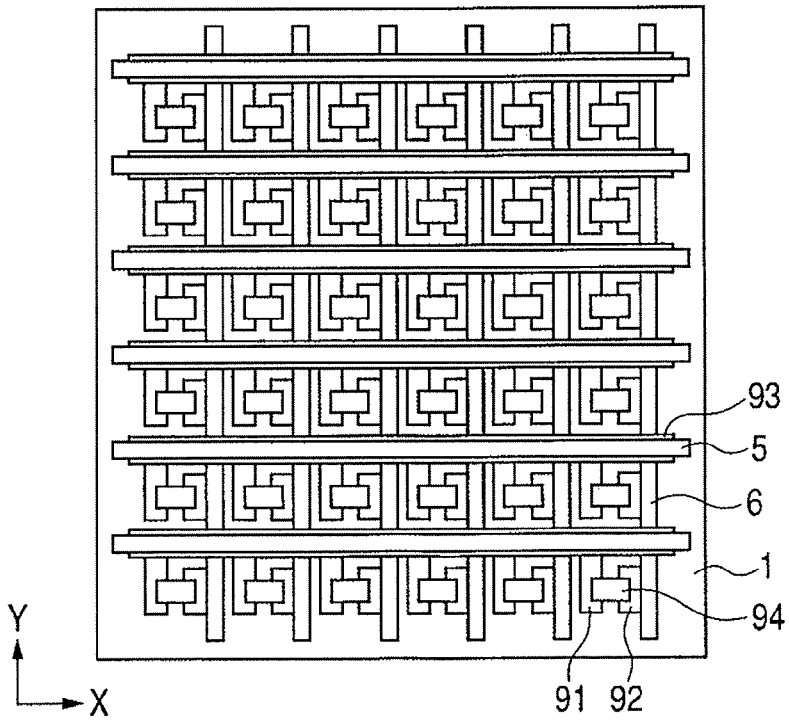
FIG. 9D is a drawing showing a production process of the electron source on the rear plate according to the present invention.

Then, a Cr film was formed by the sputtering method on the rear plate 1 on which the row wiring 5 and column wiring 6 were provided, and aperture sections corresponding to the form of the electroconductive film 94 were formed in the Cr film by the photolithographic method. Then, a solution of an organic Pd compound ("ccp-4230" made by Okuno Pharmaceutical Co., Ltd.) was coated, and baking at 300° C. for 12 minutes was performed in air for PdO particulate film to be formed. Then, the above-mentioned Cr film was removed by wet etching, and it was made the electroconductive film 94 with a predetermined form by lift-off (FIG. 9D).

Paste in which PbO was used as a main component and glass binder was mixed was further coated on the rear plate 1. In addition, a coated area was a region which is except a region (electron source region) where the first electrode 91, second electrode 92, row wiring 5, column wiring 6, and electroconductive film 94 are formed, and corresponds to an inside of the side wall 4 in FIG. 1.

As shown in FIG. 1, the side wall 4 and rear plate 1 which formed a gap between the rear plate 1 and face plate 2 are bonded using frit glass. A getter not shown was also fixed at the same time using frit glass.

[Assembly Process]

The side wall 4 bonded with the above-described rear plate 1 was bonded with the above-mentioned face plate 2 using frit glass, and a vacuum container which became the image display apparatus was completed. Bonding of a high voltage introducing terminal and an exhaust pipe was also performed at the same time. The high voltage introducing terminal is an Ag rod.

In addition, alignment was carefully performed so that positions of respective electron-emitting devices 8 of the electron source and the phosphor film 10 of the face plate 2 might correspond accurately.

The above-mentioned vacuum container was connected to an evacuation apparatus through the exhaust pipe not shown, an inside of the vacuum container was exhausted, and forming processing was performed when pressure in the vessel became $10^{-4}$ Pa or less.

Figure 10:
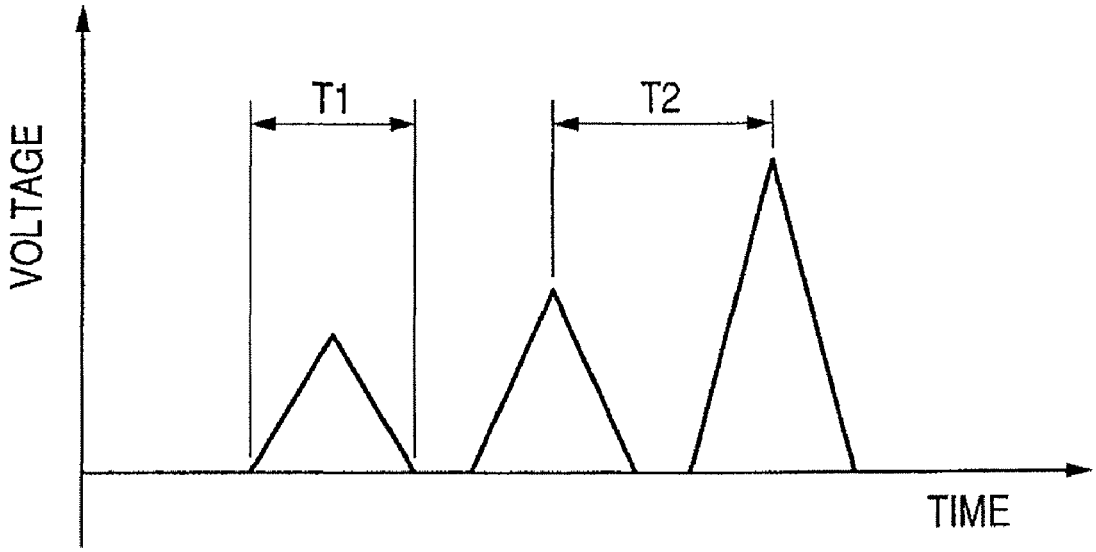
FIG. 10 is a drawing showing a voltage waveform used for a forming process of electron-emitting devices in an example of the present invention.

The forming processing was performed by applying a pulse voltage, whose peak value increases gradually as schematically shown in FIG. 10, to the row wiring 5 every line in the X direction. A pulse interval T1 was made into 10 sec., and a pulse width T2 was made into 1 msec. In addition, although not shown in drawings, a rectangular wave pulse with a peak value of 0.1 V was inserted between pulses for forming, a current value was measured, and a resistance value of electron-emitting devices was measured at the same time. When a resistance value per element exceeded 1 MΩ, the forming processing of the line was ended, and it moved to processing of the next line. This was repeated and the forming processing was completed about all the lines.

The above-mentioned vacuum container was exhausted with an ion pump with maintaining it at 200° C., pressure was decreased to $10^{-5}$ Pa or less, and acetone was introduced in the vacuum container. An introduction amount was adjusted so that the pressure might become $1.3\times10^{-2}$ Pa. Then, a rectangular wave pulse voltage with a peak value of 16 V was applied to the row wiring 5. A pulse width was made into 100 μs, the row wiring 5 to which the pulse was applied at 125-μs intervals was switched to the next line every pulse, and it was repeated to apply the pulse to each of the wiring 5 in a row direction one by one. It means that the pulse was consequently applied to each line at intervals of 10 msec. In consequence of this activation operation, since a deposited film which uses carbon as a main component near the electron-emitting region of the each electron-emitting device 8 is formed, a device current (current which flows between the first electrode 91 and second electrode 92) If becomes large.

As a stabilization process, the inside of the vacuum container was exhausted again. Exhaustion was continued for 10 hours using the ion pump, with maintaining the vacuum container at 200° C. This process is for removing organic substance molecules which remain in the vacuum container, preventing deposition of the deposited film beyond this which uses the above-described carbon as a main component, and stabilizing an electron emission characteristic.

After returning the vacuum container to room temperature, a pulse voltage was applied to the row wiring 5 by the same method as the above-mentioned activation operation. Furthermore, when the voltage of 5 kV was applied to the metal back 11 through the above-mentioned high voltage introducing terminal, the phosphor film 10 emitted light. In addition, the column wiring 6 was grounded at this time. It was confirmed by visual observation that there was not no light-emitting portion or a very dark portion, an application of the voltage to the row wiring 5 and metal back 11 was stopped, and the exhaust pipe was melted by heating for sealing to be performed. Then, getter processing was performed by high frequency heating for the image display apparatus to be completed.

When a voltage of 10 kV was applied to the metal back 11 of the image display apparatus produced as mentioned above for an image to be displayed, it was possible to display the good image which had high brightness and no image defect by a discharge. In addition, when the voltage applied to the metal back 11 of the above-mentioned image display apparatus was raised, a discharge occurred at 15 kV and an image defect occurred.

Example 2

In this example, an image display apparatus using the spacers 3 shown in FIG. 5 was produced.

However, since the same things as those in the first example were used except spacers in this example, only production of a face plate and spacers will be explained below.

[Production of Face Plate and Spacers]

A production method of the face plate 2 and spacers 3 will be explained using FIGS. 11A to 11D.

(Process a)

Soda lime glass was prepared as the face plate 2, and its surface was cleaned.

(Process b)

Bismuth oxide-based insulating paste 81 ("NP7753" made by NORITAKE) was coated on a surface of the cleaned soda lime glass by a slit coater so that a film thickness after baking might become 40 μm, and was dried at 120° C. for 10 minutes.

(Process c)

Figure 11A:
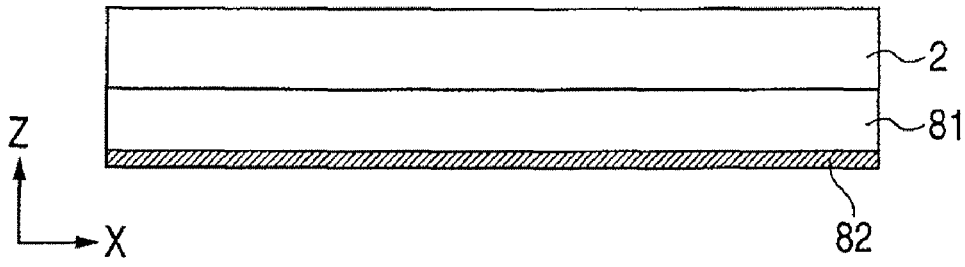
FIG. 11A is a drawing showing a production process of spacers of another embodiment according to the present invention.
Figure 11B:
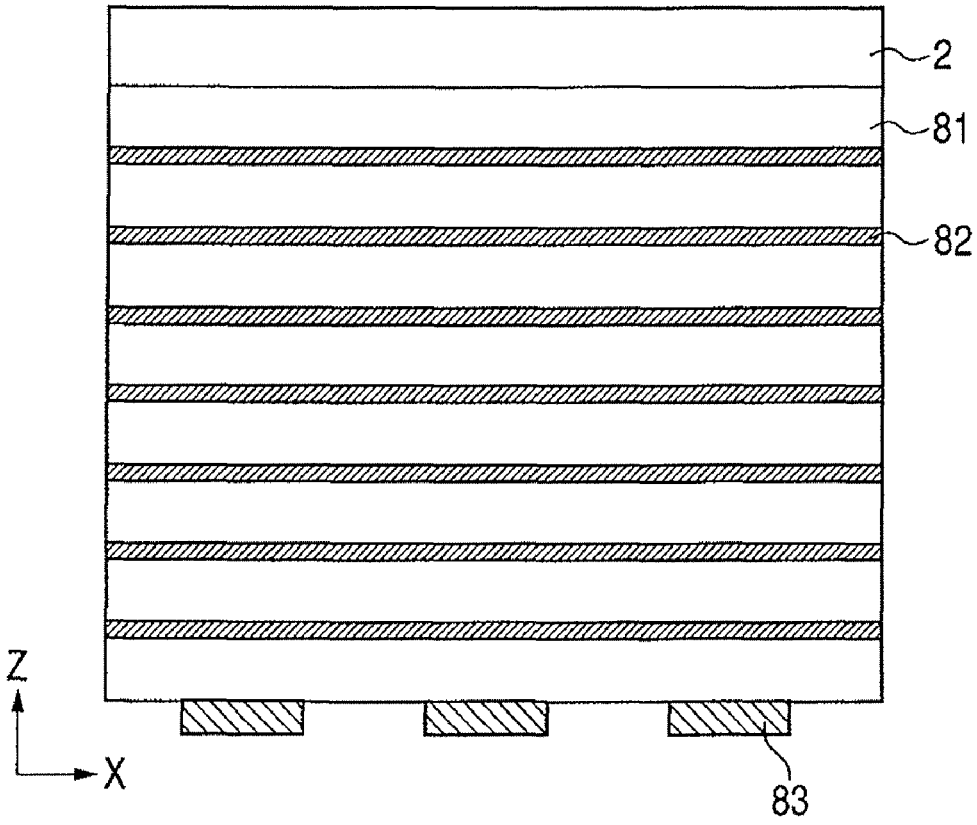
FIG. 11B is a drawing showing a production process of the spacers of the another embodiment according to the present invention.

Silver electroconductive paste 82 ("NP4732" made by NORITAKE) was formed on the dried insulating paste 81 by a slit coater so that a film thickness after baking might become 10 μm, and was dried at 120° C. for 10 minutes (FIG. 11A). Next, bismuth oxide-based insulating paste 81 ("NP7753" made by NORITAKE) was coated by a slit coater so that a film thickness after baking might become 40 μm, and was dried at 120° C. for 10 minutes.

(Process d)

Process c was repeated 6 times after that.

(Process e)

Figure 11C:
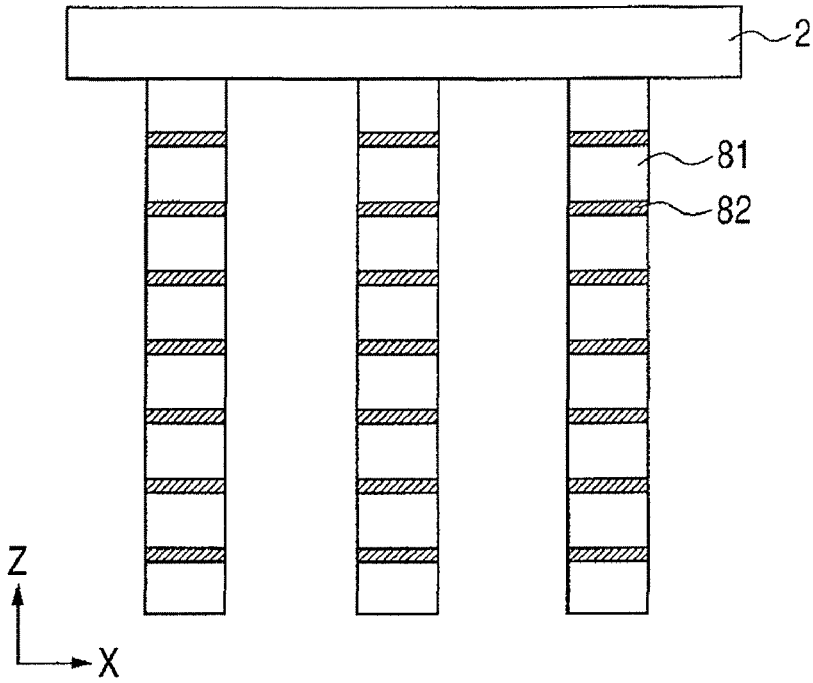
FIG. 11C is a drawing showing a production process of the spacers of the another embodiment according to the present invention.

A mask 83 for sand blasting was formed using dry film resist (DFR) (FIG. 11B), and unnecessary insulating paste was removed by sand blasting (FIG. 11C). Subsequently, the dry film resist was exfoliated with a release liquid, and cleaning was performed.

(Process f)

The insulating layer 103 was formed only in an edge of the electroconductive member 102 by a dipping method using insulating paste which had good wettability to the electroconductive member 102 and poor wettability to the insulating member 101. As composition of this insulating paste, a material containing bismuth oxide-based low melting glass frit was used. Baking at 570° C. for 10 minutes was performed.

(Process g)

The phosphor film 10 was formed between the spacers 3 by screen printing using paste in which P22 phosphors used in a CRT field were dispersed. In addition, in this example, three color of R, G, and B were stripe coated so as to produce a color display. A film thickness of the phosphor film 10 was made 15 μm.

(Process h)

Figure 11D:
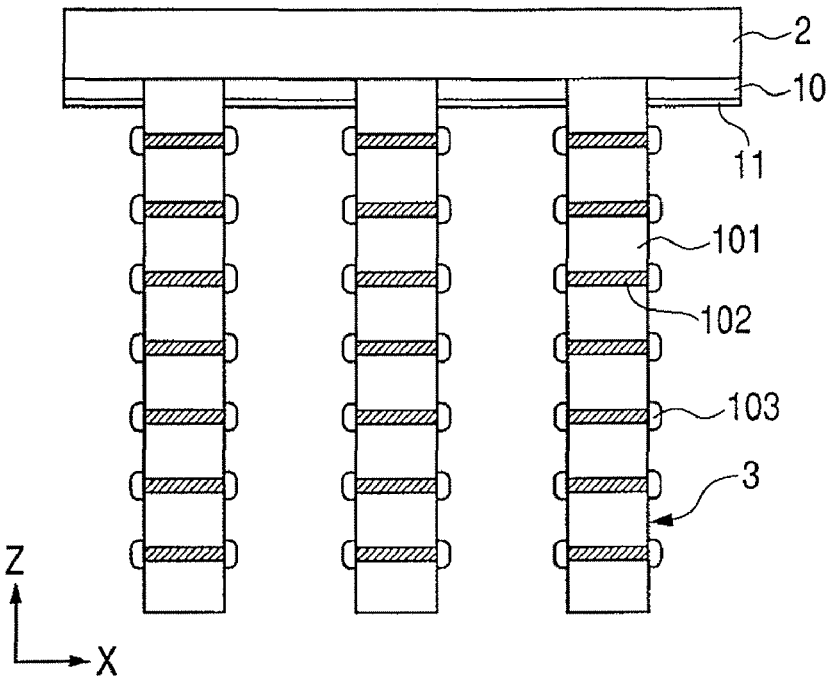
FIG. 11D is a drawing showing a production process of the spacers of the another embodiment according to the present invention.

After coating acrylic emulsion by a spray coat method on the phosphor film 10 and drying it, an aluminum film was formed by mask vacuum deposition to be made the metal pack 11. An aluminum film thickness was made to be 100 nm (FIG. 11D).

As for the spacers 3 produced through the above processes, d1 was 40 μm, d2 was 10 μm, d3 was 20 μm, W was 80 μm, h was 390 μm, and P was 160 μm.

In addition, the material used for the insulating film 103 was coated on a test pattern, and was dried and baked. When its resistance was measured, volume resistivity was $1.0\times10^{10}$ ≠·m.

According to this example, since it is possible to use DFR, used for patterning of the spacers 3, for patterning of the electroconductive member 102 as a mask, alignment becomes easy.

When a voltage of 10 kV was applied to the metal back 11 of the image display apparatus using the spacers produced as mentioned above for an image to be displayed, it was possible to display the good image which had high brightness and no image defect by a discharge. In addition, when the voltage applied to the metal back 11 of the above-mentioned image display apparatus was raised, a discharge occurred at 15 kV and an image defect occurred.

Example 3

In this example, an image display apparatus using the spacers shown in FIG. 6 was produced.

However, since the same things as those in the first example were used except spacers in this example, only production of a face plate and spacers will be explained below.

[Production of Face Plate and Spacers]

(Process a) to (Process e)

The same operations as those in Processes a to e of the second example were performed.

(Process f)

The insulating layer 103 was formed uniformly on side faces of constitutions, in which the electroconductive members and insulating members were stacked, by the dipping method using insulating paste having good wettability to both the electroconductive member 102 and insulating member 101.

(Process g)

The same operation as that in Process g of the second example was performed.

The spacer 3 produced through the above processes had the same dimensions as the spacer 3 of the second example.

In addition, the material used for the insulating film 103 was coated on a test pattern, and was dried and baked. When its resistance was measured, volume resistivity was $1.0\times10^{10}$ Ω·m.

According to this example, since what is necessary is that the insulating layer 103 is just formed uniformly on the side wall, processes become simple.

When a voltage of 10 kV was applied to the metal back 11 of the image display apparatus using the spacers produced as mentioned above for an image to be displayed, it was possible to display the good image which had high brightness and no image defect by a discharge. In addition, when the voltage applied to the metal back 11 of the above-mentioned image display apparatus was raised, a discharge occurred at 15 kV and an image defect occurred.

Example 4

In this example, an image display apparatus using the spacers shown in FIG. 7 was produced.

However, since the same things as those in the first example were used except spacers in this example, only production of a face plate and spacers will be explained below.

[Production of Face Plate and Spacers]

(Process a) to (Process e)

The same operations as those in Processes a to e of the second example were performed.

(Process f)

A solution in which electroconductive ultrafine particles whose main component was tin oxide were dispersed in an organic solvent were coated uniformly on side faces of constitutions, in which the electroconductive members and insulating members were stacked, by the dipping method, and baking at 380° C. for 10 minutes was performed. Thereby the high resistance film 104 was formed. A thickness of the high resistance film 104 was 30 nm, and its sheet resistance was $10^{13}$ Ω/□.

(Process g)

The insulating layer 103 was uniformly formed on the high resistance film 104 by the dipping method using insulating paste.

(Process h) to (Process i)

The same operations as those in Processes g and i of the second example were performed.

The spacer 3 produced through the above processes had the same dimensions as the spacer 3 of the second example.

In addition, the material used for the insulating film 103 was coated on a test pattern, and was dried and baked. When its volume resistivity was measured, it was $1.0\times10^{10}$ Ω·m.

When a voltage of 10 kV was applied to the metal back 11 of the image display apparatus using the spacers produced as mentioned above for an image to be displayed, it was possible to display the good image which had high brightness and no image defect by an electroconductive foreign material. In addition, even if it was made to display an image for a long time, it was hard to generate an image defect by a displacement of an electron beam. In addition, when the voltage applied to the metal back 11 of the above-mentioned image display apparatus was raised, a discharge occurred at 15 kV and an image defect occurred.

Example 5

In this example, similarly to the first example except changing volume resistivity of the insulating members 101 of the spacers 3, the image display apparatus shown in FIG. 1 was produced.

Hereafter, points different from the first example will be explained.

In this example, as the insulating paste 81 in Processes b to d of the first example, glass frit containing lead oxide was used. In addition, the insulating paste 81 was coated on a test pattern, and was dried and baked. When its volume resistivity was measured, it was $1.0\times10^{8}$ Ω·m.

When a voltage of 10 kV was applied to the metal back 11 of the image display apparatus, produced by the same method as that in the first example using the above-mentioned insulating paste 81, for an image to be displayed, it was possible to display the good image which had high brightness and no image defect by a discharge. In addition, when the voltage applied to the metal back 11 of the above-mentioned image display apparatus was raised, a discharge occurred at 14 kV and an image defect occurred.

Example 6

In this example, similarly to the first example except changing volume resistivity of the insulating members 101 of the spacers 3, the image display apparatus shown in FIG. 2A was produced.

Hereafter, points different from the first example will be explained.

In this example, as the insulating paste 81 in Processes b to d of the first example, glass frit containing lead oxide was used. The insulating paste 81 was coated on a test pattern, and was dried and baked. When its volume resistivity was measured, it was $1.0\times10^{6}$ Ω·m.

When a voltage of 10 kV was applied to the metal back 11 of the image display apparatus, produced by the same method as that in the first example using the above-mentioned insulating paste 81, for an image to be displayed, it was possible to display the good image which had high brightness and no image defect by a discharge. In addition, when the voltage applied to the metal back 11 of the above-mentioned image display apparatus was raised, a discharge occurred at 11 kV and an image defect occurred.

Comparative Example 1

In this comparative example, similarly to the first example except changing the spacers 3 to plate-like spacers made of glass members, the image display apparatus shown in FIG. 1 was produced.

Hereafter, points different from the first example will be explained.

After Process a of the first example, bismuth oxide-based insulating paste was coated on a surface of the cleaned soda lime glass by a slit coater so that a film thickness after baking might become 390 μm, and was dried at 120° C. for 10 minutes. Then, Processes e to g of the first example were performed.

As for the spacer 3 produced through the above processes, a width was 90 μm, h was 390 μm, and P was 160 μm.

When a voltage was applied to the metal back 11 of the above-mentioned image display apparatus produced as mentioned above, and was raised gradually, a discharge occurred at 2 kV and an image defect occurred.

Comparative Example 2

In this comparative example, similarly to the second example 2 except skipping Process f of providing the insulating layer 103 on the surfaces of the spacers 3, the image display apparatus shown in FIG. 1 was produced.

When a voltage was applied to the metal back 11 of the above-mentioned image display apparatus produced as mentioned above, and was raised gradually, a discharge occurred at 5 kV and an image defect occurred.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-049758, filed Feb. 27, 2006, which are hereby incorporated by reference herein in its their entirety.

What is claimed is:

1. An image display apparatus comprising:

a first substrate provided with an electron-emitting device;

a second substrate provided with an anode and a phosphor emitting light responsive to an irradiation with an electron emitted from the electron-emitting device, wherein the electron-emitting device and the anode and phosphor are arranged to be opposed to each other; and a spacer arranged at least in a region sandwiched between the anode and the first substrate to support the first and second substrate between the first and second substrates, wherein the spacer comprises an insulating member and a plurality of electroconductive members enveloped with the insulating member, so as not to expose surfaces of the plurality of electroconductive members, within the region sandwiched between the anode and the first substrate, and the plurality of electroconductive members enveloped with the insulating member are spaced apart from each other in a direction along which the first and second substrates are opposed.

2. The image display apparatus according to claim 1 wherein the spacer comprises a high resistance film electrically connected between the plurality of electroconductive members, and the high resistance film is covered with the insulating member.

3. The image display apparatus according to claim 1, wherein a plurality of the spacers are disposed to sandwich the electron-emitting device.

4. The image display apparatus according to claim 1, wherein the insulating member has a resistivity of $1.0\times10^{8}$ ohm/m.

5. The image display apparatus according to claim 1, wherein an electric field calculated by dividing a potential difference between the anode and the electron-emitting device by a distance between the anode and the electron-emitting device is $1.0\times10^{7}$ V/m.

6. An image receiving and displaying apparatus comprising:

the image display apparatus according to claim 1;

a receiving circuit for receiving electively a video signal;

an output circuit for generating an image signal based on the video signal received by the receiving circuit, and outputting to image signal to the image display apparatus.

* * * * *